United States Patent [19]

Piretti

[11] Patent Number: 4,943,114

[45] Date of Patent: Jul. 24, 1990

[54] CHAIR BACKREST LINKAGE MECHANISM

[76] Inventor: Giancarlo Piretti, Via Trento e Trieste 2/2, Bologna, Italy

[21] Appl. No.: 307,005

[22] Filed: Feb. 6, 1989

[51] Int. Cl.[5] ..... A47C 1/032

[52] U.S. Cl. ..... 297/301; 297/316; 403/61; 403/80

[58] Field of Search ..... 297/301, 302, 300, 316, 297/320, 340, 342; 403/61, 80

[56] References Cited

U.S. PATENT DOCUMENTS

| | | | |
|---|---|---|---|
| 142,039 | 8/1873 | Niderkorn . | |
| 799,128 | 4/1905 | Wilmot et al. . | |
| 1,045,599 | 11/1912 | Ostendorf . | |
| 1,149,421 | 8/1915 | Wilmot . | |
| 1,335,379 | 3/1920 | Lee . | |
| 1,619,503 | 3/1927 | Furlong . | |
| 2,083,838 | 6/1937 | Goenen . | |
| 2,470,364 | 5/1949 | Niederhauser . | |
| 2,616,483 | 11/1955 | Jensen . | |
| 3,394,417 | 7/1968 | O'Link | 297/317 |
| 4,761,033 | 8/1988 | Lanuzzi et al. | 297/301 X |

FOREIGN PATENT DOCUMENTS

| | | | |
|---|---|---|---|
| 2045120 | 2/1971 | France | 297/301 |

*Primary Examiner*—Peter R. Brown

*Attorney, Agent, or Firm*—Fuller, Ryan & Hohenfeldt

[57] ABSTRACT

A chair includes a compact backrest linkage mechanism for enabling the chair backrest and seat to tilt. The linkage mechanism comprises a pair of backrest levers pivotally connected to respective chair frame members near the chair back legs. A seat lever is pivotally connected to each chair frame member near the front legs. The backrest lever and seat lever pivotally connected to each chair frame member are connected to each other by an anti-friction sliding joint. Springs acting between the seat levers and chair frame members bias the seat levers and backrest levers to a normal configuration where the seat levers and backrest levers are positively located. A person sitting in the chair can tilt the backrest and simultaneously pivot the seat in only one direction from the normal configuration, that direction being to tilt the backrest backwardly and to raise the back end of the seat.

13 Claims, 2 Drawing Sheets

6
49
47
55
19
21
73
75
79
81
59
67
69
71
65
63
83
85
87
31
38
37
29

CHAIR BACKREST LINKAGE MECHANISM

BACKGROUND OF THE INVENTION

1. Field of the Invention.

This invention pertains to seating, and more particularly to chairs having tiltable seats and backrests.

2. Descriction of the Prior Art.

A large variety of chair designs have been developed over the years in attempts to provide comfort to their occupants. Chairs having tilting backrests and seats are especially comfortable, and they are in widespread use.

In some tiltable chairs, parallelogram linkages of various types are employed by which the chair seat rises in correlation with reclining of the backrest. An exemplary chair in which the seat rises and moves backwardly toward the backrest as the backrest reclines is disclosed in my co-pending U.S. Pat. Application Ser. No. 050,862, filed May 18, 1987. A major advantage of the chair of U.S. Patent Application Serial No. 050,862 is that the backrest and seat tilting mechanism occupies very little space, making it suitable for installation in stackable chairs.

In some chairs of somewhat simpler design, the seat tilts about a fixed point on the chair frame. For example, many chairs are constructed such that a reclining backrest causes a simultaneous pivoting of the seat about a pivot point located under the seat front edge. In some of those designs a reclining of the backrest causes the seat back edge to rotate upwardly about the front pivot point, i.e., the seat back end rises with backrest reclining. An example of such construction may be seen in French Patent No. 2,045,120. In the chair of the French patent, a pin and slot arrangement pivotally join the backrest to the seat to enable tilting of those components relative to the chair frame and to each other. The seat and backrest are pivotable in two directions about respective central positions. A major disadvantage of the tilting mechanism of the French chair is the frictional connection between the backrest and the seat. Further, the tilt mechanism requires a great deal of space, thereby precluding the chair from being stackable.

Thus, presently available tilting chairs are subject to further improvement and development.

SUMMARY OF THE INVENTION

In accordance with the present invention, a chair backrest linkage mechanism is provided that is simpler and more compact than prior chair backrest linkages. This is accomplished by apparatus that includes two spring loaded levers connected by an anti-friction joint and nestable within a chair frame.

The compact nature of the backrest linkage mechanisms of the present invention enable them to be used in stackable chairs. Such chairs typically include a frame comprised of a pair of front legs and a pair of back legs. A pair of transverse braces joins the tops of the two front legs and the two back legs, respectively, to each other. A longitudinally extending frame member connects the tops of each pair of corresponding front and back legs to each other.

A backrest linkage mechanism is received within each longitudinally extending chair frame member. Each linkage mechanism comprises a seat lever that is pivotally connected at a first end thereof to a chair frame member proximate a front leg. The backrest linkage mechanism further comprises a backrest lever having a first end pivotally mounted to a chair frame member proximate a back leg. Alternately, the backrest and seat levers may be pivotally mounted to a separate frame that in turn is received within a chair frame member. A chair seat is fastened to the seat levers of the backrest linkage mechanisms. Fixed to the first end of each backrest lever is a strut that rises approximately perpendicularly above the chair frame members. A backrest is assembled to the backrest lever struts.

The second ends of the seat and backrest levers are pivotally and slidingly connected to each other. Thus, tilting the strut and backrest about the pivot point between the backrest lever and the chair frame causes the backrest lever second end to urge the seat lever to pivot about its first end. To enable the backrest and seat levers to pivot freely relative to the chair frame and to each other, the connection between the second ends of the backrest and seat levers is by means of an anti-friction sliding joint. In the preferred embodiment, the sliding joint comprises a pin fixed in one of the levers. The pin passes through a bearing block that is received in a slot in the other lever. Pivoting the backrest lever causes the force therefrom to be transferred via the bearing block and pin to the seat lever. The bearing block is slidable within the slot, thereby enabling the backrest lever and seat rest lever to pivot about their respective first ends.

The backrest linkage mechanism of the present invention is biased to a normal or untilted configuration wherein the seat lever and backrest lever ar generally coplanar and lie nested within the chair frame member. Biasing is preferably accomplished by one or more strong torsion springs acting between the chair frame member and the seat lever. With the linkage mechanism in the normal configuration, the chair seat is oriented to approximately a horizontal attitude, and the struts and backrest are tilted to a fully forward position. By pushing backwardly on the backrest, a person sitting in the chair overcomes the force of the torsion springs to tilt the backrest backwardly and simultaneously lift the back end of the seat. The result is a very comfortable tilting chair that requires practically no increase in space over an ordinary chair. Consequently, the backrest linkage mechanism of the present invention is entirely suitable for use in stackable chairs.

Other objects, advantages, and benefits of the present invention will become apparent to those skilled in the art u reading the disclosure.

DETAILED DESCRIPTION OF THE INVENTION

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1:
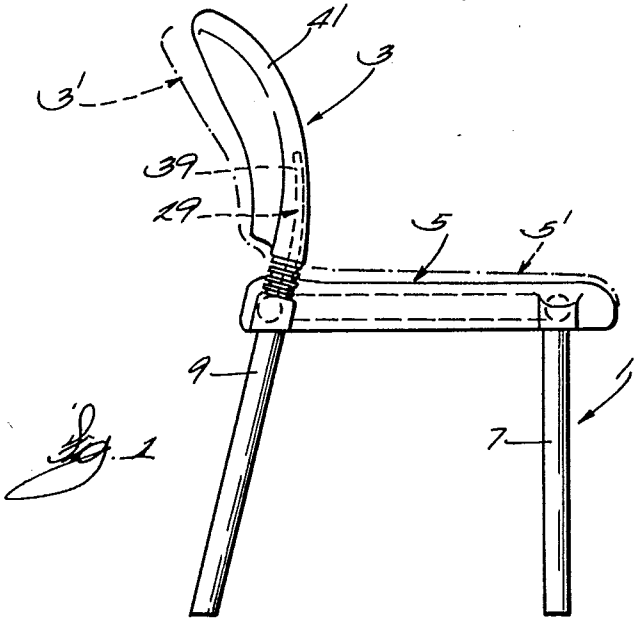
FIG. 1 is a side view of a chair that advantageously includes the backrest linkage mechanism of the present invention.

Referring to FIG. 1, a chair 1 is illustrated that includes the present invention. The particular chair depicted is merely representative of a wide variety of seating products having a tilting backrest 3 and seat 5, and it will be understood that the invention is not limited to use only on the chair design shown.

Figure 2:
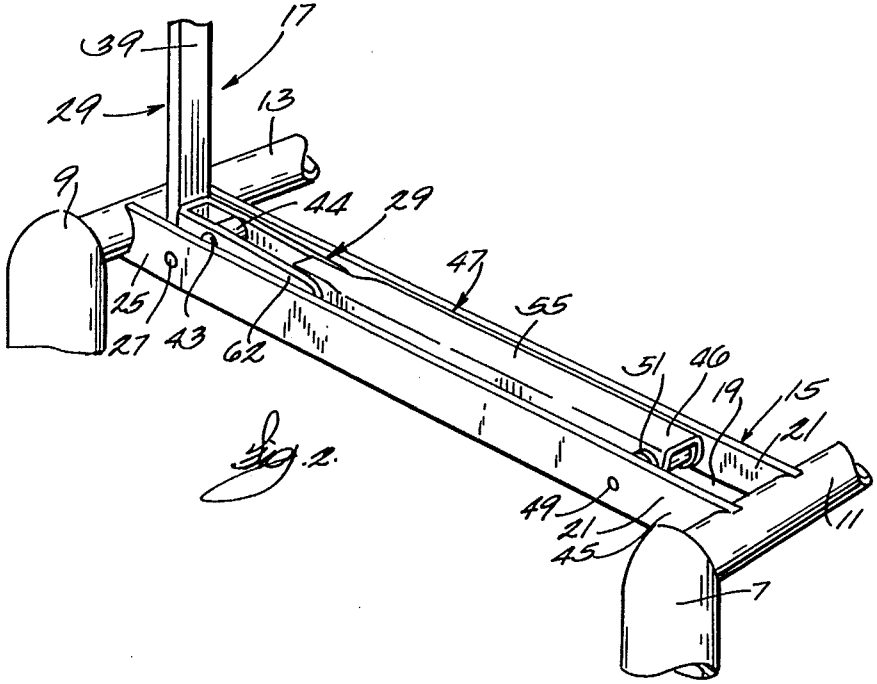
FIG. 2 is a perspective view of the backrest linkage mechanism of the present invention installed in a chair.

The chair 1 has a pair of front legs 7 and a pair of back legs 9. Looking also at FIG. 2, the top ends of the front legs 7 are joined by a horizontal transverse cross brace 11. A similar transverse brace 13 joins the tops of the back legs 9 to each other. The two braCes 11 and 13 are connected by a pair of longitudinally extending frame members 15, only one of which is shown in FIG. 2. In some chair designs, the longitudinal frame members 15 may connect the front and back legs directly, rather than through transverse braces. Preferably, the frame members 15 have channel shaped cross sections with a bottom wall 19 and a pair of spaced side walls 21 upstandingly attached to the bottom wall.

Figure 6:
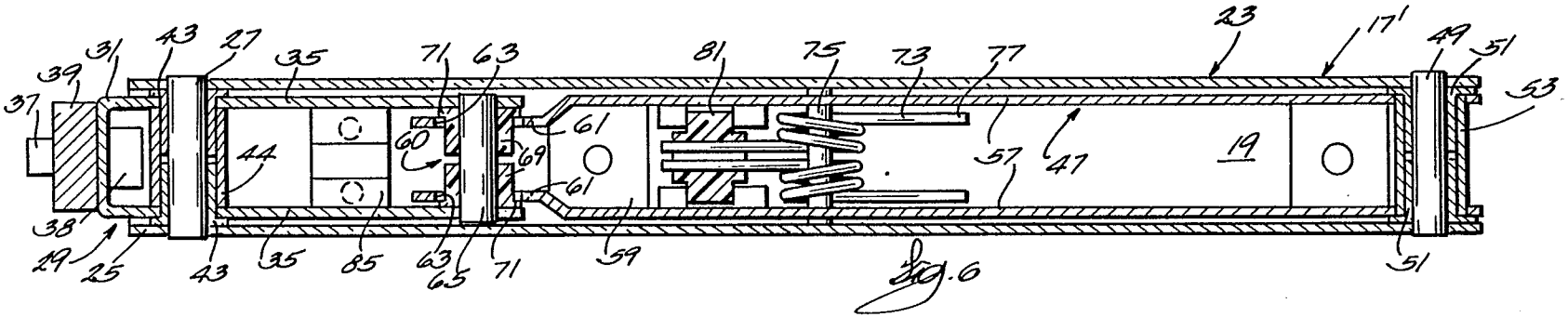
FIG. 6 is a cross sectional view taken along lines 6—6 of FIG. 4.

In accordance with the present invention, a backrest linkage mechanism 17 is incorporated into the chair 1. By means of the backrest linkage mechanism 17, a person sitting in the chair is able to tilt the backrest and seat between an untilted or normal configuration represented by the respective solid lines 3 and 5 and a tilted configuration represented by respective phantom lines 3' and 5'. A linkage mechanism 17 nests compactly within each chair frame member 15. In the design shown in FIG. 2, the frame member comprises an integral part of the linkage mechanism. Looking also at FIGS. 4–6, a modified self-contained linkage mechanism 17' is illustrated that employs a separate channel-shaped frame member 23. The entire linkage mechanism 17' is nestable within the frame member 15 of the chair 1 and is suitably attachable thereto. Other than the presence of the additional frame 23 of the linkage mechanism 17', the construction and operation of the linkage mechanisms 17 and 17' are identical, and the same reference numerals will be used to identify the respective components of the two designs.

Pivotally mounted to the chair frame member 15 or to the separate frame member 23 near the back end 25 thereof is a backrest lever 29. Pivotal mounting is by a pin 27. In the illustrated construction, the backrest lever 29 comprises a generally U-shaped clevis 31 having a back wall 33 and parallel side walls 35. Rigidly attached to the clevis back wall 33, as by a screw and nut arrangement 37, 38, is an upstanding strut 39. Suitable backrest padding and upholstery 41 are assembled to and cover the struts 39 of the two linkage mechanisms associated with each chair, as is known in the art.

The pivot pin 27 is located relatively near the back wall 33 of the clevis 31. Preferably, a pair of bushings 43 are interposed between the pin and the clevis. A spacer 44 may also be used.

Pivotally mounted to the front end 45 of the linkage mechanism frame 15 or 23 is the front end 46 of a seat lever 47. Pivotal mounting may be by a pin 49 and bushings 51, together With a spacer 53. In the preferred embodiment, the seat lever 47 is formed as an elongated generally U-shaped channel having a top wall 55 and spaced side walls 57. Reinforcing strips 59 join the side walls 57 at intervals along the length of the seat lever. Although not shown in the drawings, it will be appreciated by those skilled in the art that the seat 5 comprises a frame that attaches by any suitable means to the top walls 55 of the two seat levers.

It is a feature of the present invention that the back end 58 of the seat lever 47 is connected to the front end 62 of the backrest lever 29 by an anti-friction sliding joint 60. The sliding joint 60 includes end portions 61 of the respective seat lever walls 57. The seat lever side wall end portions 61 fit between the backrest lever side walls 35. Each seat lever side wall end portion 61 defines a slot 63. A pin 65 pressed in the backrest lever side walls 35 passes through a pair of bearing blocks 67. Each bearing block 67 comprises a rectangular hub 69 that is received in a respective seat lever slot 63. The bearing block hub heights are slightly less than the heights of the slots, and the hub widths are several millimeters less than the widths of the slots. A flange 71 extends from the hub 69 of each block, and preferably around three sides of the hub. The blocks are made of an anti-friction material, thus assuring long life and quiet friction-free operation.

Figures 3, 4, 5:
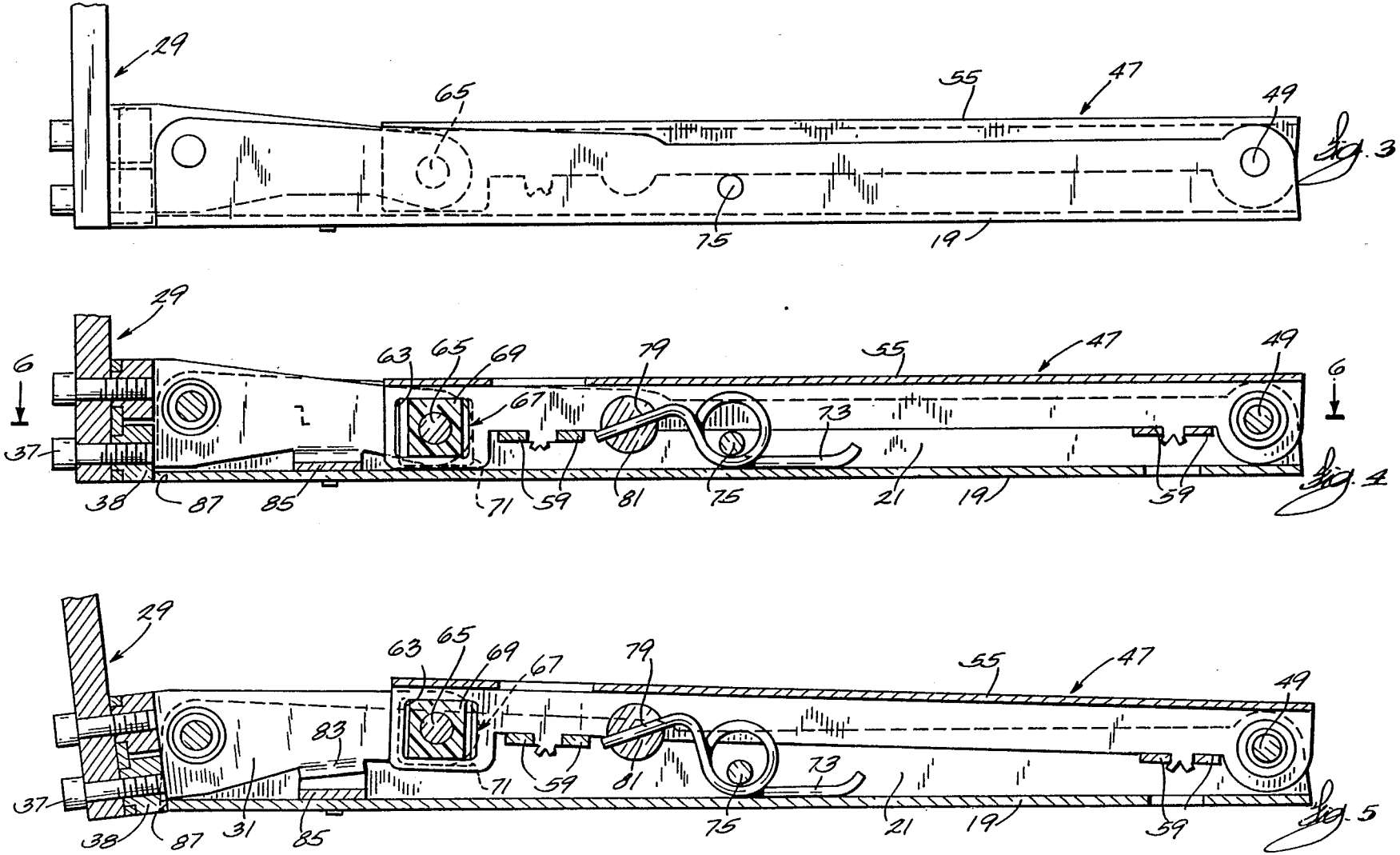
FIG. 3 is an enlarged side view of the backrest linkage mechanism of the present invention.
FIG. 4 is a longitudinal cross sectional view of the backrest linkage mechanism taken in a vertical plane and shown in the normal configuration.
FIG. 5 is a longitudinal cross sectional view similar to FIG. 4 but showing the backrest linkage mechanism in the tilted configuration.

To bias the backrest linkage mechanism 17 or 17' to the normal configuration of the solid lines 3 and 5 of FIG. 1, and as shown in FIGS. 2–4, at least one and preferably two torsion springs 73 are employed. The springs 73 are guided on a pin 75 extending between the frame member side walls 21. One end leg 77 of the spring lies against the frame member bottom wall 19. The spring second end leg 79 is inserted through a hole in a post 81 that is fixed between the side walls 57 of the seat lever 47. To control the location of the backrest lever 29 and the seat lever at the normal chair configuration, a pair of stop plates 83 are welded to the backrest lever clevis 31. The stop plates 83 abut a pad 85 on the frame member bottom wall 19 to place the linkage mechanism in the normal configuration. Preferably, the pad 85 is made of an energy absorbing non-metallic material, such as a hard rubber. When the backrest linkage mechanism is biased by the spring 73, to the normal configuration, the backrest lever and seat lever are generally coplanar, and they are nested completely within the chair frame member 15 or the separate frame 23. To control the maximum tilted configuration, a nut 38 is located to strike a back surface 87 of the frame member bottom wall 19.

In use, if a person sitting on the chair 1 does not exert pressure on the backrest 3, the backrest and seat 5 remain in their respective normal configurations as shown by the solid lines in FIG. 1, and as the backrest linkage mechanism 17 is shown in FIGS. 2–4. By exerting pressure on the backrest, the backrest and seat attain the tilted configuration as shown by the phantom lines 3' and 5' of FIG. 1, and as the linkage mechanism is shown in FIG. 5. The anti-friction joint 60 allows the relative pivoting and sliding movement between the backrest lever 29 and the seat lever 47. The backrest linkage mechanism is small enough to fit within a chair frame member 15 that is very little, if any, larger than the frame member of a conventional chair. Consequently, the chair 1 can combine the features of a simple and inexpensive tilting mechanism with stackability.

Thus, it is apparent that there has been provided, in accordance with the invention, a chair backrest linkage mechanism that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A backrest linkage mechanism comprising:
a. an elongated frame;
b. a backrest lever having a first end pivotally mounted to the frame and a second end;
c. a seat lever having a first end pivotally mounted to the frame and a second end;
d. an anti-friction sliding joint connecting the second ends of the backrest lever and the seat lever; and
e. spring means acting between the frame and at least one of the backrest lever and seat lever for biasing the backrest lever and seat lever to a normal configuration whereat the second end of at least one of the backrest lever and the seat lever is in abutting contact with the frame to locate the backrest lever and the seat lever in their respective normal configurations and whereat the seat lever and backrest lever are generally coplanar,
whereby exerting a force on the backrest lever against the spring means causes the backrest lever and the seat lever to pivot about the frame to a tilted configuration whereat the backrest lever and seat lever are non-coplanar.

2. The backrest linkage mechanism of claim 1 wherein:
a. the frame is generally channel-shaped with a bottom wall and two spaced side walls; and
b. the backrest lever and seat lever are substantially completely nested within the frame when the spring means biases the backrest lever and seat lever to the normal configuration.

3. A backrest linkage mechanism comprising:
a. an elongated frame;
b. a backrest lever having a first end pivotally mounted to the frame and the second end;
c. a seat lever having a first end pivotally mounted to the frame and a second end;
d. an anti-friction sliding joint connecting the second ends of the backrest lever and the seat lever; and
e. spring means acting between the frame and at least one of the backrest lever and seat lever for biasing the backrest lever and seat lever to a normal configuration whereat the second end of at least one of the backrest lever and the seat lever is in abutting contact with the frame to locate the backrest lever and the seat lever in their respective normal configurations and whereat the seat lever and backrest lever are generally coplanar, wherein the spring means comprises:
i. a post fixed to the seat lever and defining at least one hole therein;
ii. a pin fixed to the frame; and
iii. a torsion spring guided on the pin and having an end leg that is received in the post hole,
where by exerting a force on the backrest lever against the spring means causes the backrest lever and the seat lever to pivot about the frame to a tilted configuration whereat the backrest lever and seat lever are non-coplanar.

4. A chair comprising:
a. a pair of front legs and a pair of back legs;
b. a pair of spaced frame members connecting corresponding front legs and back legs to each other near the
c. a pair of seat levers, each seat lever having a first end pivotally mounted to a respective frame member near the front leg and a second end;
d. a pair of backrest levers, each backrest lever having a first end pivotally mounted to a respective frame member near the back leg and a second end;
e. an anti-friction sliding joint connecting the respective second ends of the seat levers and backrest levers to each other;
f. a seat fastened to the seat levers;
g. a backrest upstandingly attached to the backrest levers; and
h. spring means coacting between each seat lever and the respective frame member for biasing the seat levers and backrest levers to a normal configuration whereat the seat is in a generally horizontal attitude and the backrest is in a generally vertical attitude and the seat levers and backrest levers are generally coplanar,
whereby exerting a force on the backrest against the spring means causes the backrest levers and the seat levers to pivot about their respective first ends to a tilted configuration whereat the backrest levers and the seat levers are non-coplanar.

5. The chain of claim 4 wherein the frame members are generally channel-shaped, and wherein the seat levers and backrest levers are nested substantially completely within the respective frame members when the spring means biases the seat levers and backrest levers to their respective normal configurations.

6. A chain comprising:
a. a pair of front legs and a pair of back legs;
b. a pair of spaced frame members connecting corresponding front legs and back legs to each other near the respective top ends thereof;
a pair of seat levers, each seat lever having a first end pivotally mounted to a respective frame member near the front leg and a second end;
d. a pair of backrest levers, each backrest lever having a first end pivotally mounted to a respective frame member near the bag leg and a second end;
e. an anti-friction sliding joint connecting the respective second ends of the seat levers and backrest levers to each other;
f. a seat fastened to the seat levers;
g. a backrest upstandingly attached to the backrest levers; and
h. spring means coacting between each seat lever and the respective frame member for biasing the seat levers and backrest levers to a normal configuration whereat the seat is in a generally horizontal attitude and the backrest is in a generally vertical attitude and the seat levers and backrest levers are generally coplanar, wherein the spring means comprises:
i. a post fixed to each seat lever and having at least one hole therein;
ii. a torsion spring guided on the pin in each frame member and having respective end legs that are received in the corresponding seat lever post holes.

7. In combination with a chain having a seat, a backrest, front and back legs, and at least one longitudinally extending frame member for joining the front and back legs near the top ends thereof;

at least one backrest linkage mechanism comprising:

a. a seat lever supporting the seat and having a first end pivotally mounted to the chair frame member near the front leg thereof and a second end;

b. a backrest lever supporting the backrest and having a first end pivotally mounted to the frame member near a chair back leg and a second end;

c. an anti-friction sliding joint connecting the second ends of the seat and backrest levers to each other; and d. spring means coacting between the seat lever and the frame member for biasing the backrest lever and seat lever to a normal configuration whereat the seat lever and backrest lever are generally coplanar, whereby applying a force on the backrest against the spring means overcomes the biasing thereof to pivot the backrest lever and the seat lever to a tilted configuration whereat the seat lever and backrest lever are non-coplanar.

8. The combination of claim 7 wherein the second end of at least one of the seat lever and the backrest lever is in abutting contact with the chair frame member to locate the backrest lever and seat lever in the normal configuration.

9. The combination of claim 7 wherein the seat lever and backrest lever lie nested substantially completely within the chair frame member when they are biased to their respective normal configurations.

10. In combination with a chair having a seat, a backrest, front and back legs, and at least one longitudinally extending frame member for joining the front and back legs near the top ends thereof, at least one backrest linkage mechanism comprising:

a. a seat lever supporting the seat and having a first end pivotally mounted to the chair frame member near the front leg thereof and a second end;

b. a backrest lever supporting the backrest and having a first end pivotally mounted to the frame member near a chair back leg and a second end, wherein the backrest lever and seat lever are formed as elongated generally channel-shaped members having respective opposed side walls, and wherein the opposed side walls of the second end of a selected one of the backrest lever and seat lever are formed with tapered sections that terminate in side wall end portions that fit between the side walls of the other of the selected backrest lever and seat lever, and wherein at least one of the side walls at the second end of the selected one of the backrest lever and seat lever defines a slot therein;

c. an anti-friction sliding joint connecting the second ends of the seat and backrest levers to each other, wherein an anti-friction bearing block is received in the slot in the selected one of the seat lever or backrest lever, and a pin passes through the anti-friction bearing block and is secured in the side walls of the other of the selected backrest lever and seat lever; and d. spring means coacting between the seat lever and the frame member for biasing the backrest lever and seat lever to a normal configuration whereat the seat lever and backrest lever are generally coplanar, so that the slots, anti-friction bearing block, and pin cooperate to form the anti-friction sliding joint and thereby enable the backrest lever and seat lever to pivot and slide relative to each other when the backrest lever and seat lever pivot in the frame member at the respective first ends thereof.

11. The combination of claim 10 wherein:

a. the side walls of the second end of the seat lever are formed with tapered sections that terminate in respective end portions that fit between the side walls of the backrest lever;

b. the side walls of the seat lever at their respective end portions are formed with slots; and c. the anti-friction bearing block is received in a slot in the seat lever.

12. The combination of claim 11 wherein:

a. the anti-friction sliding joint comprises two anti-friction bearing blocks, an antifriction bearing block being received in the slot of each side wall of the seat lever; and b. the pin is secured in the side walls of the backrest lever.

13. The combination of claim 10 wherein the anti-friction bearing block comprises:

a. a hub passing through a slot in the selected one of the seat lever or backrest lever, the hub defining a hole therethrough for receiving the pin; and b. a flange extending outwardly from the hub, the flange being interposed between a side wall of the seat lever and a side wall of the backrest lever.

* * * * *

UNITED STATES PATENT AND TRADEMARK OFFICE

CERTIFICATE OF CORRECTION

PATENT NO. : 4,943,114

DATED : July 24, 1990

INVENTOR(S) : Giancarlo Piretti

It is certified that error appears in the above-identified patent and that said Letters Patent is hereby corrected as shown below:

Column 6, Line 5:
Insert --- respective top ends thereof; --- after "the".

Column 6, Line 30:
Delete "chain" and substitute --- chair ---.

Column 6, Line 36:
Delete "chain" and substitute --- chair ---.

Column 6, Line 63:
Insert --- a pin fixed to each frame member; and --- after "ii".

Column 6, Line 63:
Indent and insert --- iii --- before "a torsion spring ..."

Column 6, Line 67:
Delete "chain" and substitute --- chair ---.

UNITED STATES PATENT AND TRADEMARK OFFICE

CERTIFICATE OF CORRECTION

PATENT NO. : 4,943,114

DATED : July 24, 1990

INVENTOR(S) : Giancarlo Piretti

It is certified that error appears in the above-identified patent and that said Letters Patent is hereby corrected as shown below:

Column 8, Line 36:
Delete "antifriction" and substitute ---anti-friction---.

Signed and Sealed this

Third Day of March, 1992

*Attest:*

HARRY F. MANBECK, JR.

*Attesting Officer*

*Commissioner of Patents and Trademarks*